US008146917B2

(12) United States Patent
Shinjo et al.

(10) Patent No.: US 8,146,917 B2
(45) Date of Patent: Apr. 3, 2012

(54) CONVEYING DEVICE WITH ROLLER SEPARATING UNIT

(75) Inventors: Ryoya Shinjo, Kawasaki (JP); Shin Genta, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 88 days.

(21) Appl. No.: 12/575,880

(22) Filed: Oct. 8, 2009

(65) Prior Publication Data

US 2010/0090396 A1 Apr. 15, 2010

(30) Foreign Application Priority Data

Oct. 9, 2008 (JP) ..... 2008-262996
Feb. 26, 2009 (JP) ..... 2009-044323

(51) Int. Cl.
*B65H 5/02* (2006.01)

(52) U.S. Cl. ..... 271/273; 271/274

(58) Field of Classification Search ..... 271/273, 271/274; 226/1, 2, 15–23; 399/21, 124
See application file for complete search history.

(56) References Cited

U.S. PATENT DOCUMENTS

| | | | | |
|---|---|---|---|---|
| 4,346,883 | A * | 8/1982 | Speraggi | 271/274 |
| 4,611,939 | A * | 9/1986 | Fujiwara | 400/637 |
| 4,982,946 | A * | 1/1991 | Uchimura et al. | 271/251 |
| 5,080,346 | A * | 1/1992 | Okuzawa | 271/258.02 |
| 5,765,825 | A * | 6/1998 | Watase | 271/9.13 |
| 7,420,718 | B2 * | 9/2008 | Shimizu | 358/498 |
| 7,658,381 | B1 * | 2/2010 | Moore et al. | 271/273 |

FOREIGN PATENT DOCUMENTS

| | | |
|---|---|---|
| JP | 10-194522 A | 7/1998 |
| JP | 2008-105836 A | 5/2008 |

* cited by examiner

*Primary Examiner* — Jeremy R Severson
(74) *Attorney, Agent, or Firm* — Canon USA, Inc., I.P. Division

(57) ABSTRACT

A conveying device performs an appropriate initialization sequence at start of an operation thereof in response to a manipulation of a lever of a non-operational conveying mechanism thereof. The conveying device includes a pair of rollers configured to convey a sheet, a separating unit configured to separate one of the pair of rollers from another of the pair of rollers, a holding unit configured to retain a status representing whether a separation process is performed by the separating unit, a memory unit configured to store information representing a state of the conveying device at power-off, and a control unit configured to control the conveying device based on the status retained by the holding unit and the information stored by the memory unit.

13 Claims, 18 Drawing Sheets

CONVEYING DEVICE WITH ROLLER SEPARATING UNIT

BACKGROUND OF THE INVENTION

1. Field of the Invention

The present invention relates to a conveying device for conveying a sheet, and a recording apparatus having the conveying device.

2. Description of the Related Art

A conveying device for conveying a sheet in a recording apparatus, such as a printer, a copying machine, or a facsimile apparatus, performs a predetermined operation when the device is powered on (i.e., at power-on).

For example, Japanese Patent Application Laid-Open No. 10-194522 discusses a technique of a cut-sheet conveying device. According to this technique, an internal memory stores information representing whether a sheet-jam (paper-jam) occurs before power is turned off. It is determined, based on information stored in the memory and information output from a sheet detection sensor provided on a conveying path at power-on, whether an operation of discharging a cut-sheet is performed.

Japanese Patent Application Laid-Open No. 2008-105836 discusses the following problems. When a sheet is set in a printer by obliquely inclining the sheet to a conveying roller of a conveying device, a skew feed and a lateral deviation of the sheet are caused while the sheet is conveyed. To prevent occurrence of the skew feed and the lateral deviation, the device performs a sequence operation (lateral-deviation correction sequence) for correction to make a sheet follow a conveying roller by feeding the sheet a certain amount after the sheet is set. A predetermined operation has surely been performed as the lateral-deviation correction sequence operation, regardless of a condition of the sheet set in a power-on state, and independent of a user's operation performed in a power-off state.

For example, when a user touches a main unit in a power-off state, the condition of the set roll sheet can be deviated. More specifically, the condition of the set sheet when a state of the device shifts from the power-on to the power-off, can differ from that of the set sheet when the device is powered on. Accordingly, when an initialization operation is omitted at power-on, a front edge position of a sheet can be deviated. Thus, a position of a margin of the sheet and a margin amount thereof can be changed. Alternatively, in a recording operation, the interior of the device can be stained by recording information in a portion off the edges of a sheet. Accordingly, an initialization operation is surely performed. However, when the condition of the sheet is not changed in the power-off state, the execution of the initialization operation is useless. A conveyance correction sequence requires an execution time (e.g., 30 seconds). Consequently, there has been a problem that an operation throughput of the printer is reduced.

SUMMARY OF THE INVENTION

The present invention is directed to a conveying device and a recording apparatus having the conveying device, which can solve the above problems.

According to an exemplary embodiment of the present invention, a conveying device includes a pair of rollers configured to convey a sheet, a separating unit configured to separate one of the pair of rollers from another of the pair of rollers, a holding unit configured to retain a status representing whether a separation process is performed by the separating unit, a memory unit configured to store information representing a state of the conveying device at power-off, and a control unit configured to control the conveying device based on the status retained by the holding unit and the information stored by the memory unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 1 is a flowchart illustrating a process of performing an initialization operation of a first exemplary embodiment of the present invention at power-on.

FIG. 2 illustrates a flowchart illustrating determination processing performed in the first exemplary embodiment of the present invention at power-on.

DESCRIPTION OF THE EMBODIMENTS

Various exemplary embodiments, features, and aspects of the invention will be described in detail below with reference to the drawings.

Figure 4:
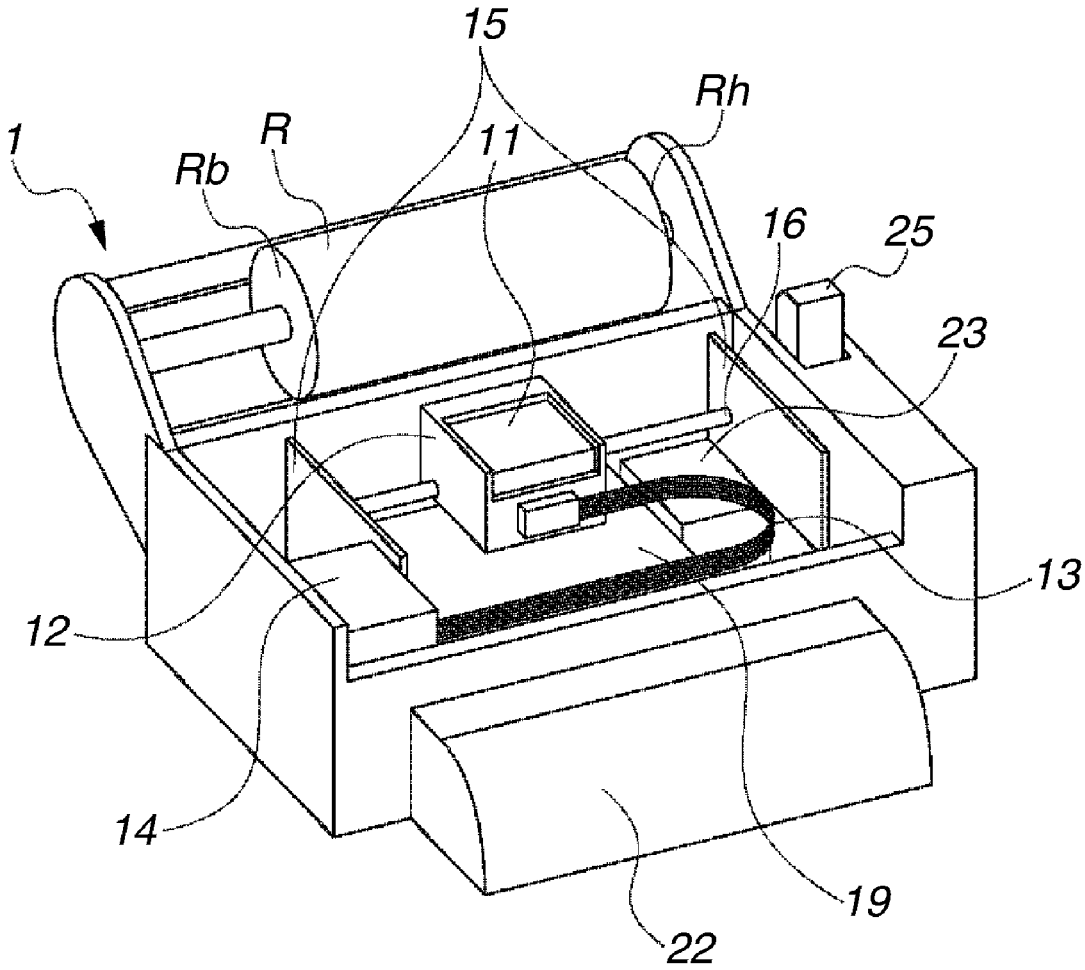
FIG. 4 is a perspective view illustrating a printer according to the first exemplary embodiment of the present invention.

FIG. 4 is a perspective view illustrating a recording apparatus (printer) 1 according to a first exemplary embodiment of the present invention.

As illustrated in FIG. 4, the printer 1 includes a carrier (carriage) 12 on which a recording head 11 is mounted, a platen 19 which holds a recording medium, and a guide shaft 16 both end portions of which are fixed to a frame 15. The carrier 12 is supported to be able to scan along the guide shaft 16 and a guide rail (not shown).

The recording head 11 includes a plurality of nozzles (not shown), from which a plurality of types of ink having different colors are discharged. Ink of each color is supplied from an ink tank 14 via a supply tube 13 to a nozzle provided in the recording head 11.

The carrier 12 is caused to scan a recording medium (sheet of paper) conveyed to a position at which information is recorded by the recording head thereon. Ink is discharged from the recording head 11. Thus, an image is recorded on the sheet. The carrier 12 is reciprocated by a belt drive unit (not shown) and a motor (not shown). A recording head recovery unit 23 is provided at a position at which the recording head recovery unit 23 can face the recording head 11 when the recording head 11 is displaced to a home position provided in vicinity of one end of a displacement range thereof. The head recovery unit 23 is operated during a recording operation (scanning-and-recording). The head recovery unit 23 prevents clogging of the recording head 11 by performing capping, sucking, wiping, and the like on the recording head 11.

A release lever 25 can be operated by a user, regardless of whether the apparatus is powered on or off. A pinch roller 9 and a roller 10 of a roller pair are separated from each other by operating the release lever 25, so that the nip therebetween is released. The release lever 25 is operated to remove, when a sheet-jam occurs in a conveying path, a jammed sheet therefrom. For example, when a sheet is jammed on the platen 19, the release lever 25 is operated. Thus, the nip between the rollers 9 and 10 of the roller pair can be released, so that a sheet nipped by the rollers can be taken out of the device.

Figure 5:
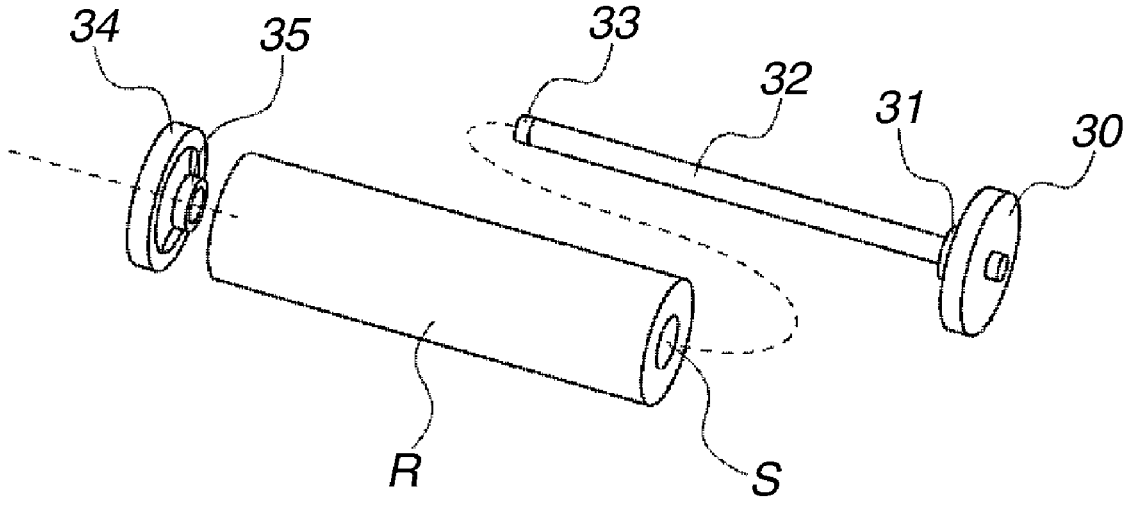
FIG. 5 illustrates a roll sheet according to the first exemplary embodiment of the present invention.

Next, a roll sheet holder and a roll sheet R are described below by referring to FIG. 5. A roll sheet which is a continuous-form sheet wound like a roll can be used as a recording medium according to the present embodiment. As shown in a perspective view illustrated in FIG. 5, in the roll sheet R, a spool shaft 32 is passed through a paper core S provided in an own winding central-portion. The roll sheet R is fixedly held by causing a reference-side paper core locking portion 31 of a reference-side roll sheet holder 30 arranged on the spool shaft 32 to bite into an inner wall of the paper core S with a radially elastic force. The reference-side roll sheet holder 30 is fixed to the spool shaft 32. In addition, a non-reference-side roll sheet holder 34 is passed through by the spool shaft 32 from a side opposite to the reference-side roll sheet holder 30 and set to be attached to the paper core S.

The non-reference-side roll sheet holder 34 has a non-reference-side paper core locking portion 35, so that the roll sheet R is fixedly held by the paper core S with a radially elastic force. A torque limiter 33 is provided on an axis of the spool shaft 32. When the roll sheet R rotates therearound, a rotational load is given by the torque limiter 33 thereto. As illustrated in FIG. 4, both ends of the spool shaft 32 are turnably supported on a printer body. Thus, the roll sheet R is turnably held. In the printer according to the present embodiment, a reference for positioning a roll sheet is located at a right side, as viewed in FIG. 4.

A roll sheet is set by employing the right side as a reference therefor. The reason therefor is that a displacement time of the carrier 12 should be taken into consideration due to necessity for displacing the recording head 11 onto the recovery unit 23 during printing, as described above. Therefore, a print time can be reduced by setting a roll sheet to the side at which the recovery unit 23 is provided. Accordingly, in the following description, it is assumed that a roll sheet has a reference-side end Rh which is a right-side sheet end, a non-reference-side end Rb which is a left-side sheet end, and a sheet leading edge Rp.

Figure 6:
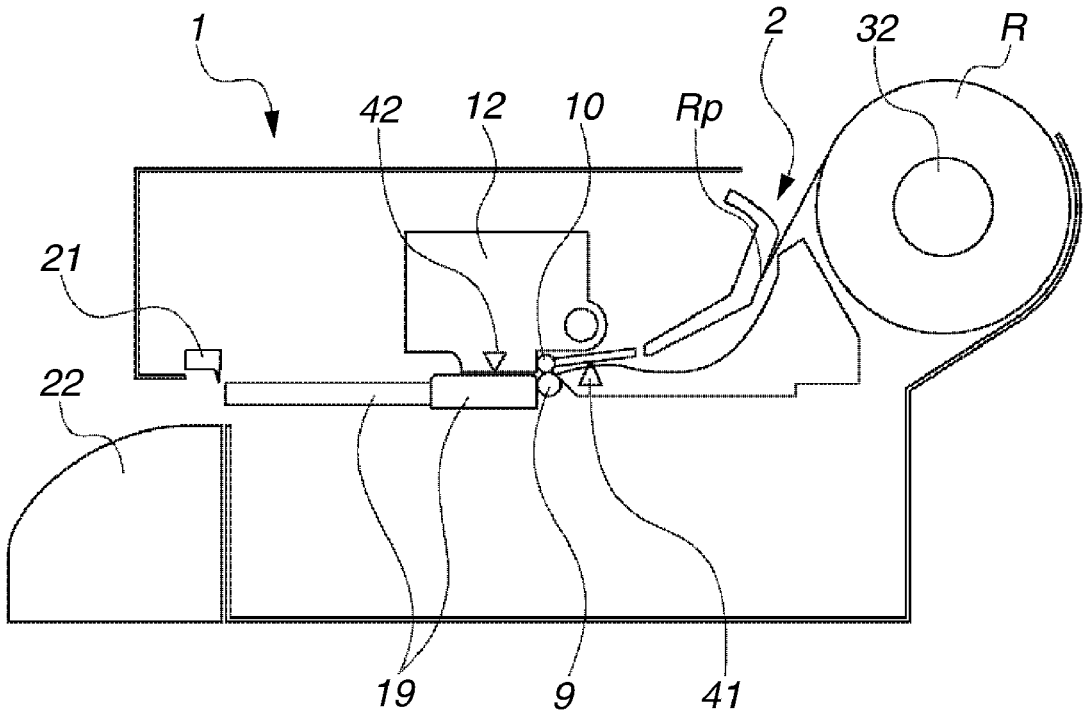
FIG. 6 is a cross-sectional view illustrating the printer according to the first exemplary embodiment of the present invention, which is taken from the side of a reference end.

Next, setting (installation) of a roll sheet in a printer is described by referring to a schematic cross-sectional view of a printer, which is illustrated in FIG. 6. A sheet leading edge Rp of a roll sheet R is guided by a user's hand to a conveying port 2. In this state, the roll sheet R is rotated counter-clockwise (CCW). The leading edge Rp of the roll sheet R is passed through a conveying path and fed in a downstream direction. A sheet detection sensor 41 of a reflection type is provided midway of the conveying path.

The sheet leading edge Rp of the roll sheet R is moved by the user's hand to a downstream side in a conveying direction on the conveying path. When the sheet detection sensor 41 detects the sheet leading edge Rp, a control unit of the printer performs the following operation.

Figure 7A:
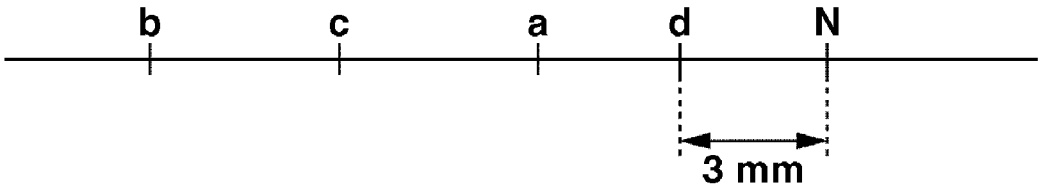
FIGS. 7A, 7B, and 7C illustrate positions of a leading edge Rp of a roll sheet in a conveying direction in a conveying operation of the first exemplary embodiment of the present invention.

First, the rollers 9 and 10 of the roller pair start to rotate in a CCW direction which is a sheet conveying direction. In addition, the carriage is displaced so that a detection sensor 42 mounted on the carrier (carriage) 12 is placed on the conveying path. When the sheet leading edge Rp of the roll sheet R, guided by the user's hand, reaches the rollers 9 and 10 of the roller pair, which are rotating, the sheet R is conveyed by the rollers 9 and 10 of the roller pair. Then, when the detection sensor 42 detects the leading edge Rp of the roll sheet R, the rollers 9 and 10 of the roller pair is stopped after rotated a predetermined amount. As a result of the above operation, as illustrated in FIG. 7A, the leading edge Rp of the roll sheet R reaches a predetermined position a located downstream from a nip position N of the nip between the rollers 9 and 10 of the roller pair. Then, a lateral deviation correction sequence (to be described below) is performed additionally. Thus, the leading edge Rp of the roll sheet R stops at a predetermined position d located downstream from the nip position N. Additionally, a state in which an operation of the printer is started when the sheet leading edge Rp of the roll sheet R guided by the user's hand is detected by the sheet detection sensor 41, as described above, is referred to as an unfed sheet standby state (first standby state) hereinafter.

Figure 7B:
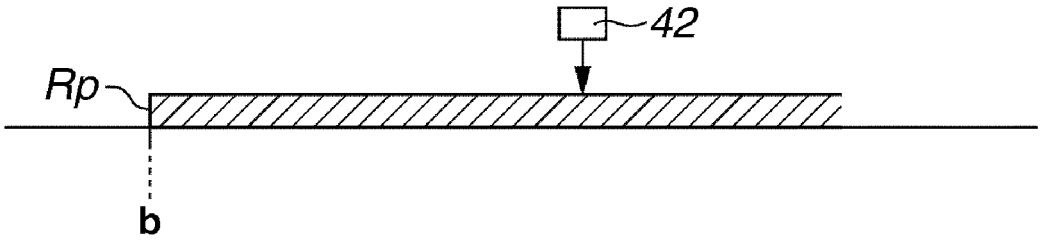
Figure 8A:
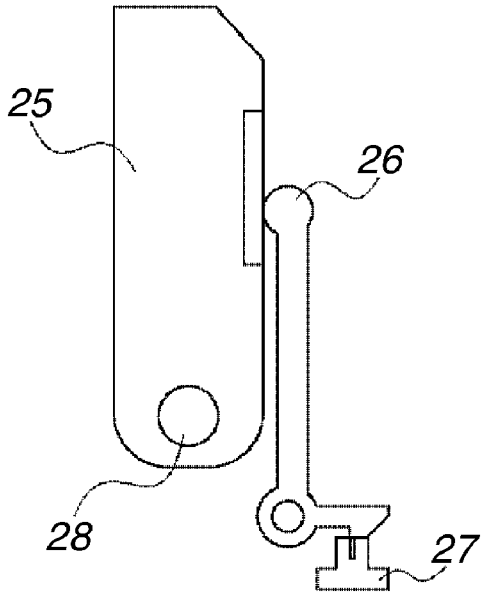
FIGS. 8A and 8B illustrate a configuration of a detection unit for detecting the presence of occurrence of a nip release according to the first exemplary embodiment of the present invention.
Figure 8B:
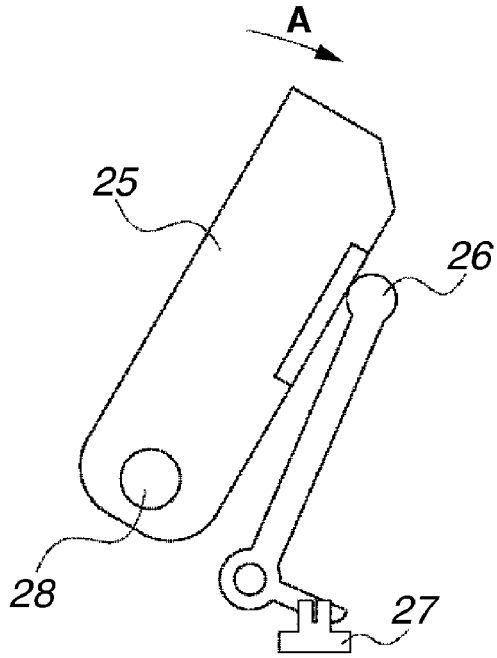

A detection unit is described below, which detects that an operation for a separation process (nip release process) is performed, with reference to FIGS. 8A and 8B. A mechanical flag 26 and a photosensor 27 for detecting a state of the mechanical flag 26 are provided in vicinity of the release lever 25 for performing a nip release operation. The photosensor 27 detects a state of the mechanical flag 26 at predetermined timing after power-on. When the release lever 25 is operated (i.e., moved in a direction of arrow A), the state of the mechanical flag 26 is changed from that illustrated in FIG. 7A to that illustrated in FIG. 7B. The state illustrated in FIG. 7B is a state in which the photosensor 27 is shielded from light. When the position of the mechanical flag 26 is once changed from that illustrated in FIG. 8A to that illustrated in FIG. 8B, the mechanical flag 26 maintains the position illustrated in FIG. 8B by a force of a spring (not shown) even though the release lever 25 is subsequently operated. An application specific integrated circuit (ASIC) (control unit) 61 (to be described below) causes, after the state of the mechanical flag 26 is detected using the photosensor 27, a solenoid to operate, so that the state illustrated in FIG. 8A is returned to the state illustrated in FIG. 8B. Consequently, the state of the mechanical flag 26 is changed to an initial state.

As described above, the ASIC (control unit) 61 acquires information representing the state of the photosensor 27 after power-on. Thus, the ASIC (control unit) 61 determines whether an operation of the release lever 25 during power-off is performed. Then, the ASIC (control unit) 61 initializes the mechanical flag 26.

Figure 9:
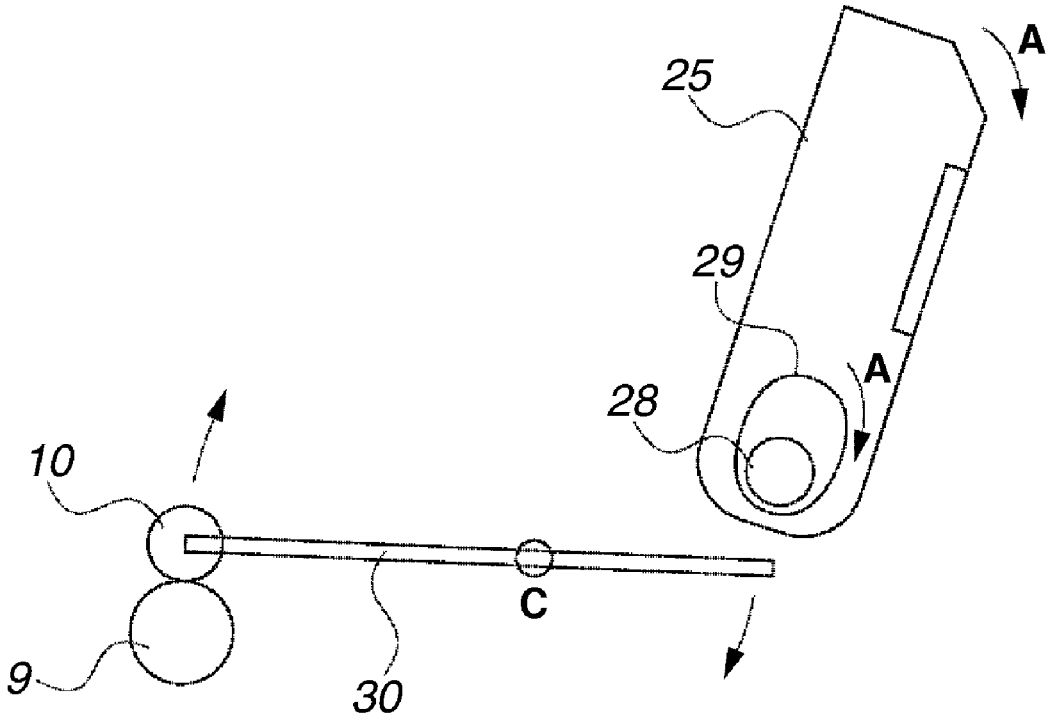
FIG. 9 illustrates a nip opening/closing mechanism according to the first exemplary embodiment of the present invention.

FIG. 9 illustrates a separation mechanism (nip release unit) for separating one of the rollers of the roller pair from the other roller of the roller pair in response to an operation of the release lever 25. As illustrated in FIG. 9, a cam 29 and the release lever 25 are provided on the same shaft 28. When the release lever 25 is operated in the direction of arrow A illustrated in FIG. 8B, the cam 29 rotates in the direction of arrow A, as illustrated in FIG. 9. The rotation of the cam 29 causes a member (pinch roller holder) 30 to turn around a position C in the direction of arrows. Consequently, the pinch roller 10 is separated from the roller 9, so that the nip between the rollers 8 and 10 of the roller pair is released.

Figure 10:
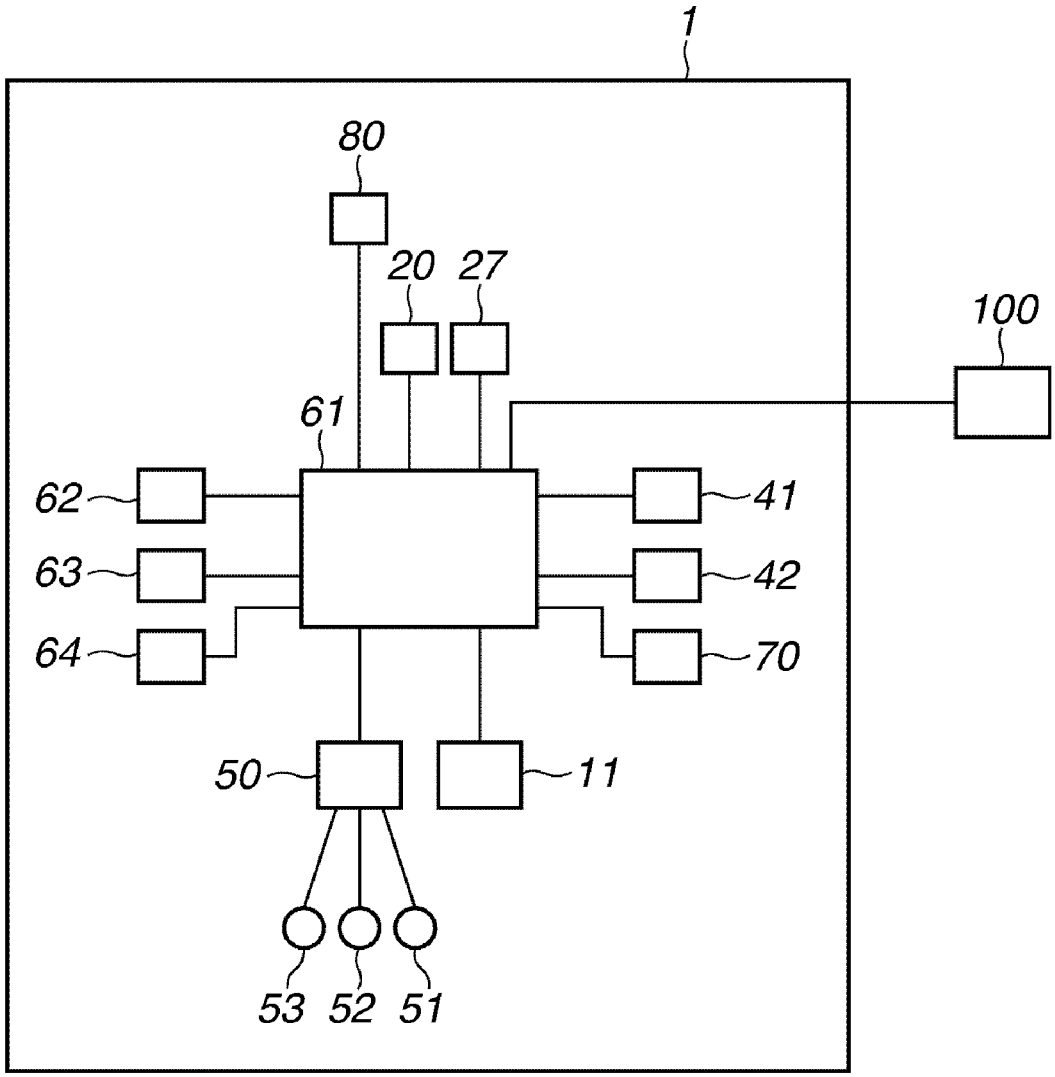
FIG. 10 is a block diagram illustrating a configuration of a control unit of the printer according to the first exemplary embodiment of the present invention.

Next, a configuration of a control system of the printer 1 is described hereinafter by referring to FIG. 10. The ASIC (application specific integrated circuit) 61 includes recording head control block, a motor control block, a data processing block, a communication control block for communicating with a host apparatus, and the like, in addition to a central processing unit (CPU). A random access memory (RAM) 62 stores information for recording data and performing a control operation. This information includes positional information representing a position of a sheet end portion (to be described below). A read-only memory (ROM) 63 stores a program for performing a control operation which will be described below. An electrically erasable programmable read-only memory (EEPROM (nonvolatile memory)) 64 is a memory-device that stores information even when power is turned off. The EEPROM 64 stores information representing a state of the printer at power-off. The sensor 41 is provided on the conveying path. The sensor 42 is provided at the carriage 12. The sensor 27 is provided at the nip release unit. A solenoid 20 is provided at the nip release unit. A motor drive unit 50 drives the motor. A carrier motor 51 is a drive source for displacing the carrier. A conveying motor 52 is a drive source for causing the roller 9 to rotate. A motor 53 is a drive source for causing a roll sheet to rotate. An operation unit 70 is provided with a display unit for displaying a state of the device, and with a power button. The ASIC 61 outputs a signal to a power supply 80 in response to an operation of the power button. The ASIC 61 receives image data from the host apparatus and performs data conversion processing and the like. Then, the APIC 61 transfers the processed data to the recording head 11.

Next, a roll-sheet initialization operation at power-on is described below with reference to FIG. 1. This initialization operation premises that at least the roll sheet R is set in the printer, and that the leading end of the sheet is placed downstream from the rollers 9 and 10 of the roller pair. The initialization operation to be performed on the roll sheet is controlled based on information regarding the presence of separation processing (nip release processing) (i.e., whether the separation processing (nip release processing) is performed) and information representing a state of the printer at power-off.

First, in step S101, the control unit 61 makes a determination regarding the initialization operation, based on the information regarding the presence of the nip release processing and the information representing a state of the printer at power-off. If a result of the determination satisfies a condition "A", the process is finished without performing no processing. If the result of the determination meets another condition "B", the process proceeds to step S104, in which a lateral-deviation correction sequence (to be described below) is performed. If the result of the determination meets yet another condition "C", the process proceeds to step S102, in which a sheet cutting sequence is performed to discharge an image recorded on a sheet. In this sequence, first, a sheet is conveyed so that an image recorded on the sheet is placed downstream in a conveying direction from a position at which a cutter 21 illustrated in FIG. 4 is placed. Next, a sheet cutting operation using the cutter 21 is performed. A cross-section of the cut-sheet corresponds to a leading edge Rp. Thus, in step S103, a conveying operation is performed to displace the leading edge Rp to the position a (see FIG. 7A). Then, in step S104, a lateral-deviation correction sequence is performed.

Figure 1:
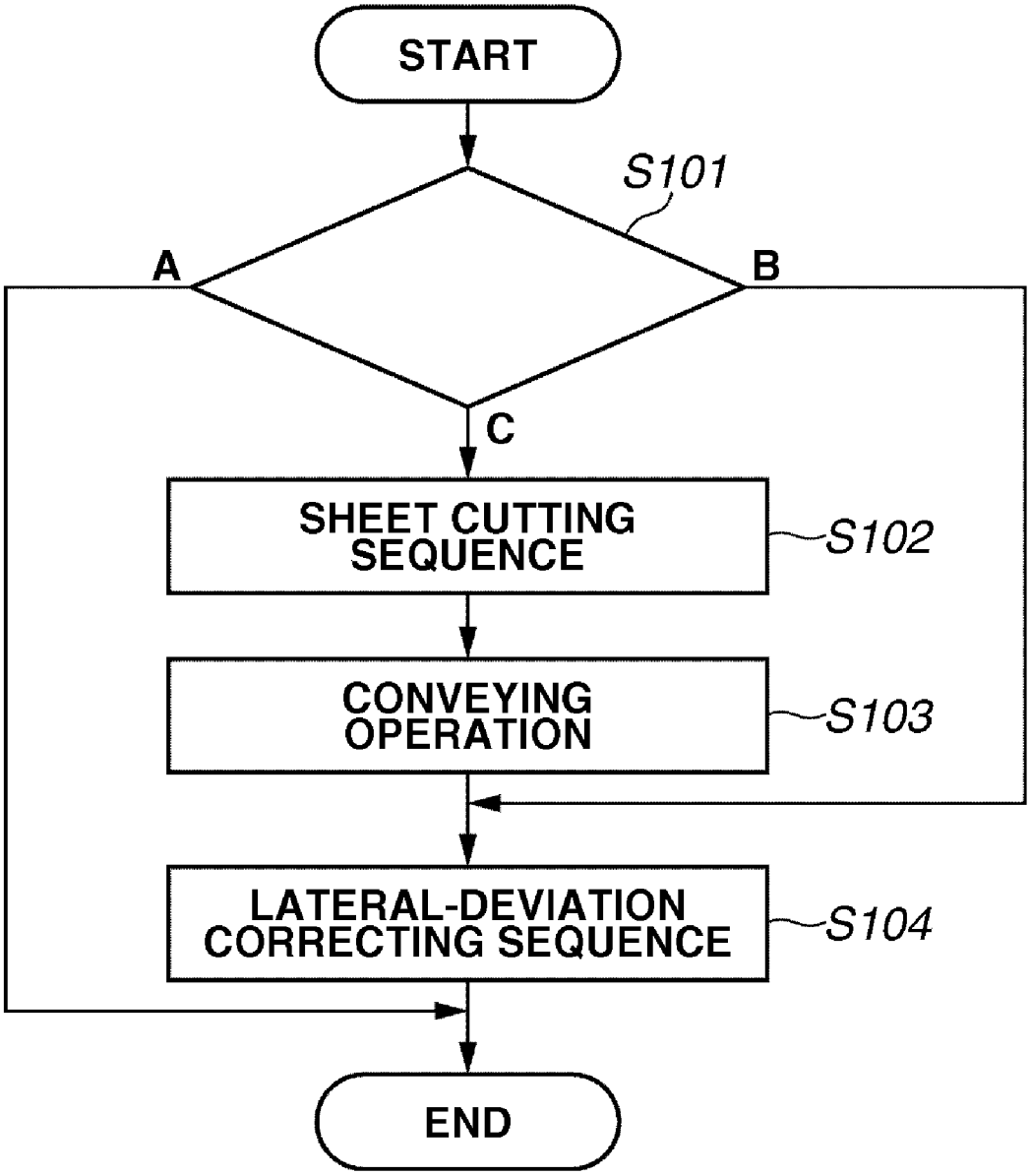
Figure 2:
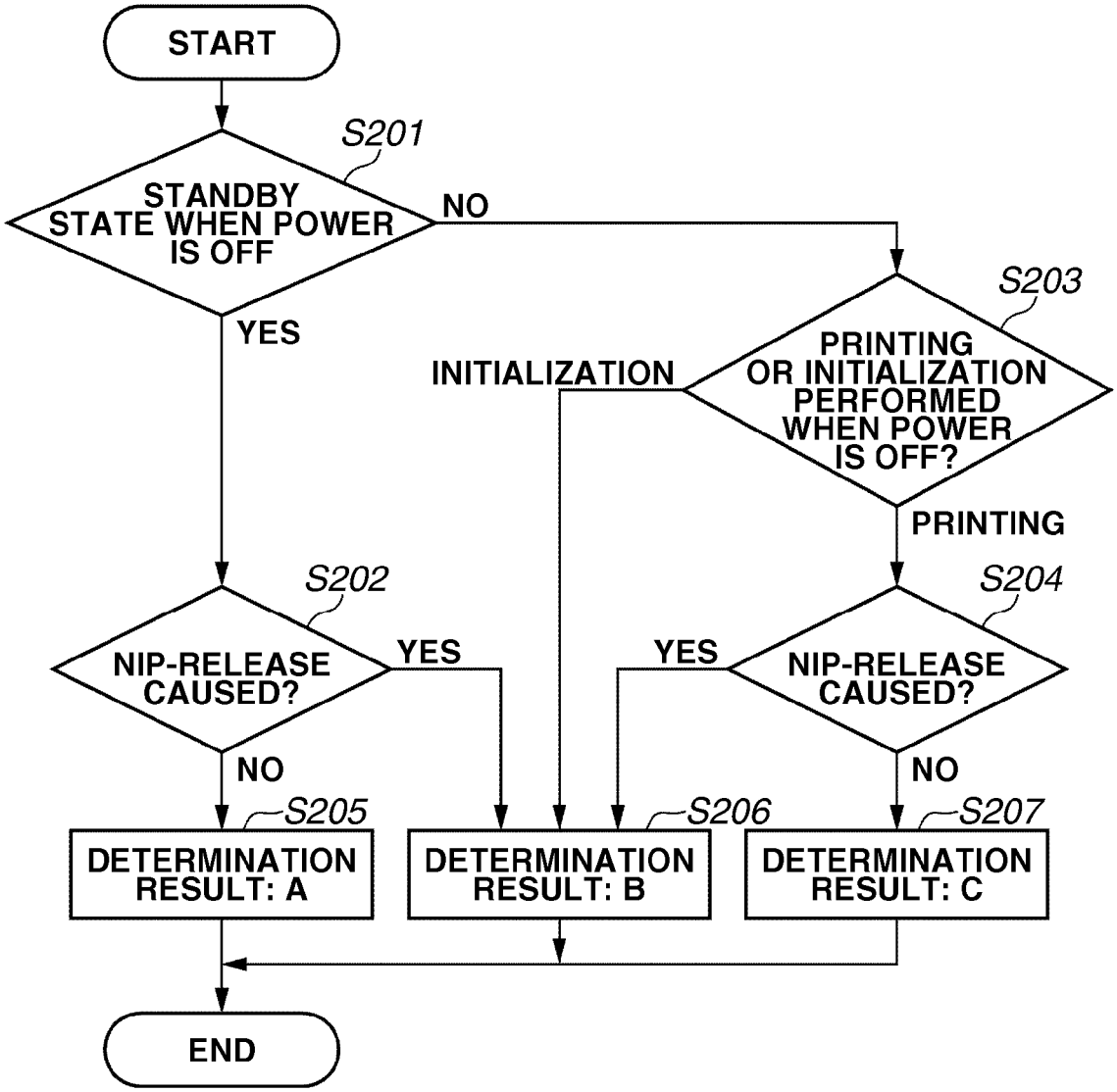

Next, contents of determination processing performed in step S101 illustrated in FIG. 1 are described below with reference to FIG. 2. In step S201, the control unit 61 determines whether the state of the printer at power-off is a standby state. If the state of the printer at power-off is a standby state (YES in step S201), the processing proceeds to step S202. On the other hand, if the state of the printer at power-off is not a standby state (NO in step S201), the processing proceeds to step S203. In step S202, the control unit 61 determines the presence or absence of occurrence of the nip release at power-off (when power is turned off).

If the nip release occurs (the nip release is caused (YES in step S202)), the processing proceeds to step S206, in which the control unit 61 determines that the result of the determination processing satisfies the condition "B". On the other hand, if the nip release does not occur (the nip release is not caused (NO in step S202)), the processing proceeds to step S205, in which the control unit 61 determines that the result of the determination processing satisfies the condition "A". However, if the state of the printer at power-off is not a standby state (NO in step S201), the control unit 61 determines whether the state of the printer at power-off is a state in which an initialization operation is being performed, or in which recording is being performed. If the state of the printer at power-off is a state in which the roll sheet is being initialized (during an initialization operation), the processing proceeds to step S206, in which the control unit 61 determines that the result of the determination processing satisfies the condition "B". On the other hand, if the state of the printer at power-off is a state in which recording is being performed, the processing proceeds to step S204. In step S204, the control unit 61 determines the presence or absence of occurrence of the nip release at power-off, similarly to S202. If the nip release occurs (YES in step S204), the processing proceeds to step S206, in which the control unit 61 determines that the result of the determination processing satisfies the condition "B".

If the state of the printer at power-off is a state in which the nip release does not occur (NO in step S204), the control unit 61 determines that the result of the determination processing satisfies the condition "C". As described above, the control unit 61 makes the determination based on the information representing the presence or absence of the nip release processing, and the information representing the state of the printer at power-off.

Here, it is assumed that a power-off state is caused, for example, by a failure (or interruption) of power supply due to a power blackout or to unplugging of a cable, in addition to the case of causing a power-off state by a user's operation.

Thus, types of information (or flag), which correspond to the states of the printer, are predetermined. The operation is controlled such that the information representing the state of the printer is updated according to change in the state of the printer.

A flag representing an initialized state and that representing an operating condition are set in the nonvolatile memory provided in the printer. Upon completion of each operation, a control operation of changing the contents of each flag stored in the nonvolatile memory is carried out. Consequently, occurrence of an abrupt power interruption can reliably be known during an operation of the device.

The term "standby state" represents, e.g., a state in which a recording operation can be started when the printer receives a recording instruction. This standby state is a state upon completion of an initialization operation or a recording operation. When a user performs an operation on the power button of the operation unit to thereby turn off power, a state of the device at power-off is set as a standby state.

Figure 3:
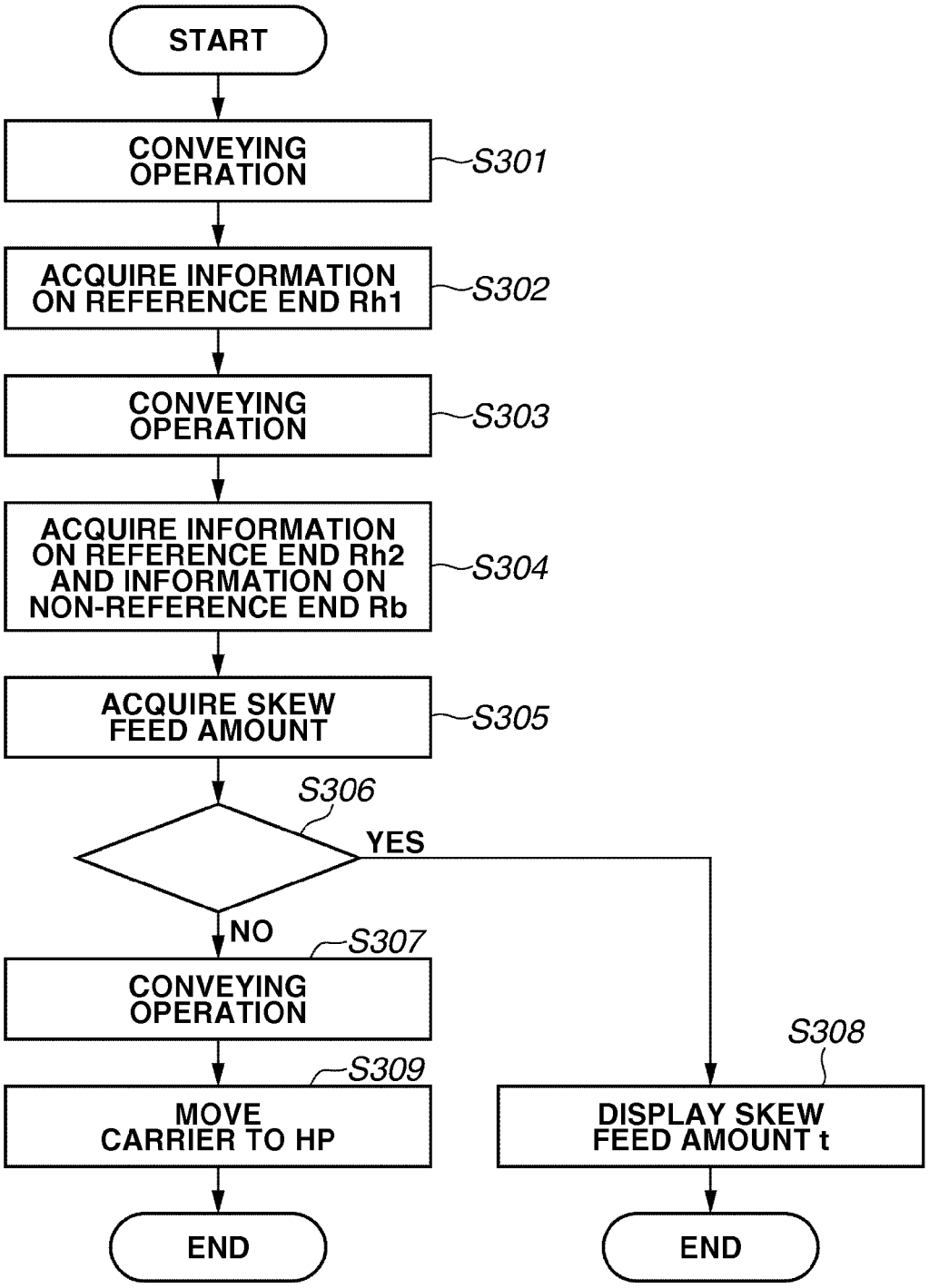
FIG. 3 is a flowchart illustrating a lateral-deviation correction sequence performed in the first exemplary embodiment of the present invention.

Next, an initialization operation is described with reference to FIG. 3. In S301, a conveying operation is performed. The roller 9 conveys a sheet to a predetermined position. This operation is performed for lateral-deviation correction. In a case where a user manually supplies a sheet, sometimes, the lateral deviation of lateral end portions of the sheet occurs. Thus, an initialization operation is performed in order to restrain occurrence of a lateral deviation state. As described above, a conveying operation is performed using the rollers 9 and 10 of the roller pair in a state in which the torque limiter is provided on the spool shaft and in which a predetermined rotational load is given to a roll sheet R. Thus, occurrence of a lateral deviation state of the roll sheet R is restrained.

Next, in step S302, the carrier 12 is caused to scan (or move along) the sheet. Thus, the reference-side end (reference end) Rh1 of the sheet is detected. Information about the position of the reference-side end is stored in the memory, based on the detection of the reference-side end.

Next, in step S303, a conveying operation is performed to acquire information about the positions of the reference-side end Rh2 and the non-referenced side end Rb at the upstream side in the conveying direction.

In step S304, the carrier 12 is displaced to acquire information about the position of the reference end of the sheet. Thus, the reference-side end Rh2 and the sheet end Rh are detected. Information about the position of each of the ends is stored in the memory, based on the detection thereof.

In step S305, a skew feed amount is acquired. The degree of a skew feed (a skew feed amount) is acquired based on the precedingly acquired information about the position of each of the reference-side ends Rh1 and Rh2 and the distance therebetween (corresponding to an amount of rotation of each roller).

In step S306, the control unit 61 determines whether the skew feed amount is larger than a predetermined threshold. If the skew feed amount is larger than the threshold (YES in step S306), in step S308, the skew feed amount is displayed in the display unit to cause a user to set the sheet again. If the skew feed amount is smaller than the threshold, in step S307, the sheet is conveyed so that the leading edge Rp of the roll sheet R reaches a predetermined position provided upstream therefrom. The predetermined position is at a distance of 5 mm downstream from the rollers 9 and 10 of the roller pair.

In step S309, the carrier 12 is displaced to the position of the recovery unit 23 illustrated in FIG. 6. Then, the carrier stands by at this position in a capped state. This standby state is referred to as a feed-finished standby state (second standby state). This standby state is continued until print data is received.

Figure 7C:
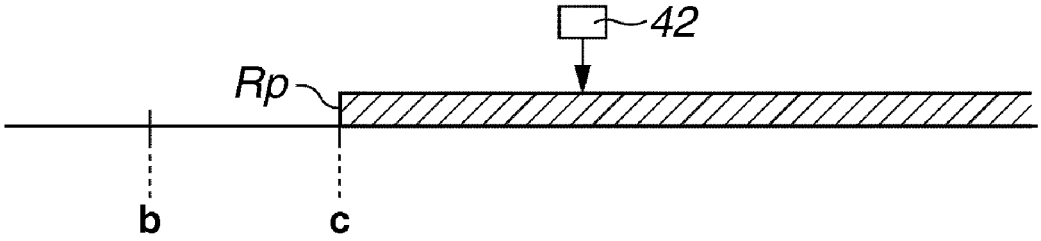

When the sheet is conveyed to a downstream side, the roll sheet R is rotated accompanying and pulled by the rollers 9 and 10 of the roller pair. In a case where the roller 9 is put into a decelerated state or a stopped state during the accompanying rotation of the roll sheet R therewith, the roll sheet R continues to perform the rotation by an own inertia force. Thus, a rotational load is given to the roll sheet R by the torque limiter 33 illustrated in FIG. 7, so that the rotation of the roll sheet R is stopped in a short time.

When the leading edge Rp of the roll sheet R is conveyed to an upstream side in the conveying direction by rotating the roller 9 in the opposite direction (CW direction), the roll sheet R is rotated using the motor (not shown) as a drive source at an increased speed in comparison with a sheet conveying speed of the roller 9 so that the roll sheet does not loosen on the conveying path. Even in the case of performing this operation, a winding operation is performed via the torque limiter to prevent the sheet from being subjected to excessive tension and from being torn off.

Information about a sheet width (sheet width information) is acquired based on information representing the positions of the reference-side end Rh2 and the non-reference-side end Rb. The information about a sheet width (sheet width information) is acquired using a result of calculating the difference between the position of the reference-side end Rh2 and the non-reference-side end Rb. When there is a disagreement between the width represented by the acquired sheet width information and a sheet width corresponding to print data, the sheet width information is used to inform a user of the disagreement.

Next, an operation of the device at power-on/power-off is described below. In the present embodiment, power is turned on/off by pressing the power button provided in the device. An operation of the rollers 9 and 10 is not performed during power-off but the power is interrupted as it is. On the other hand, when power is turned off in the middle of the lateral-deviation correction sequence illustrated in FIG. 1, the sequence operation is interrupted. Then, the roller 9 and the roll sheet R are rotated in the CW direction, so that the leading edge Rp of the sheet is conveyed to the position a.

When the power button is depressed in the middle of recording, a recording operation is interrupted. The roll sheet is conveyed to a downstream side. Then, a sheet including a recorded region is cut by the cutter 21. The roller 9 and the roll sheet R rotate in the CW direction. Thus, the cut portion (the leading edge Rp of the roll sheet R) is conveyed to the position a. Subsequently, power is interrupted.

As described above, when a user operates the power button provided on the operation unit to turn off power, the leading edge of the sheet is held at a predetermined standby position (the position a illustrated in FIG. 7) in a power-off state. More specifically, when a user turns off a power supply by performing an operation of the power button of the operation unit, the state of the device at power-off is a standby state.

Figure 11:
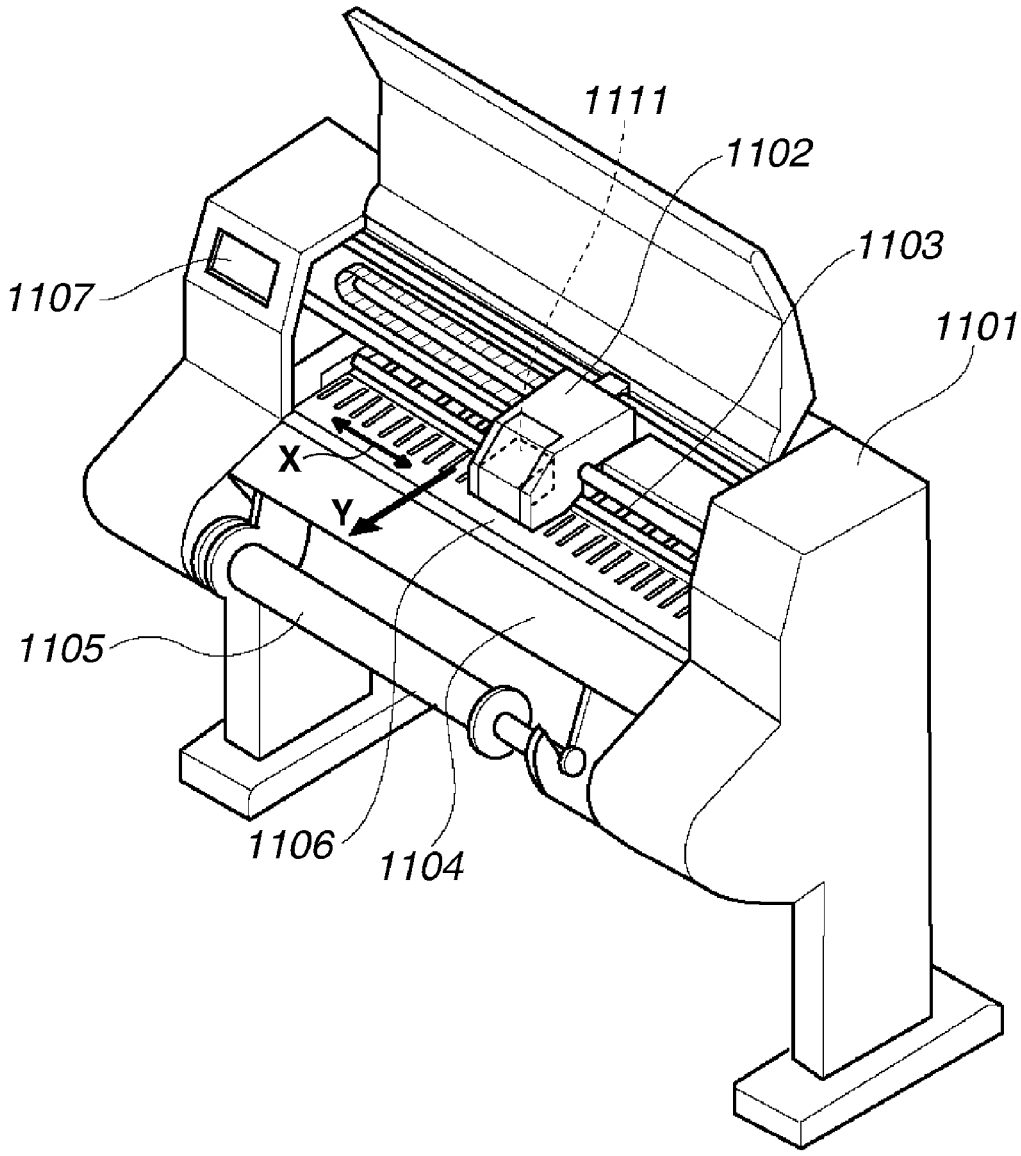
FIG. 11 is a perspective view illustrating a printer according to a second exemplary embodiment of the present invention.
Figure 12:
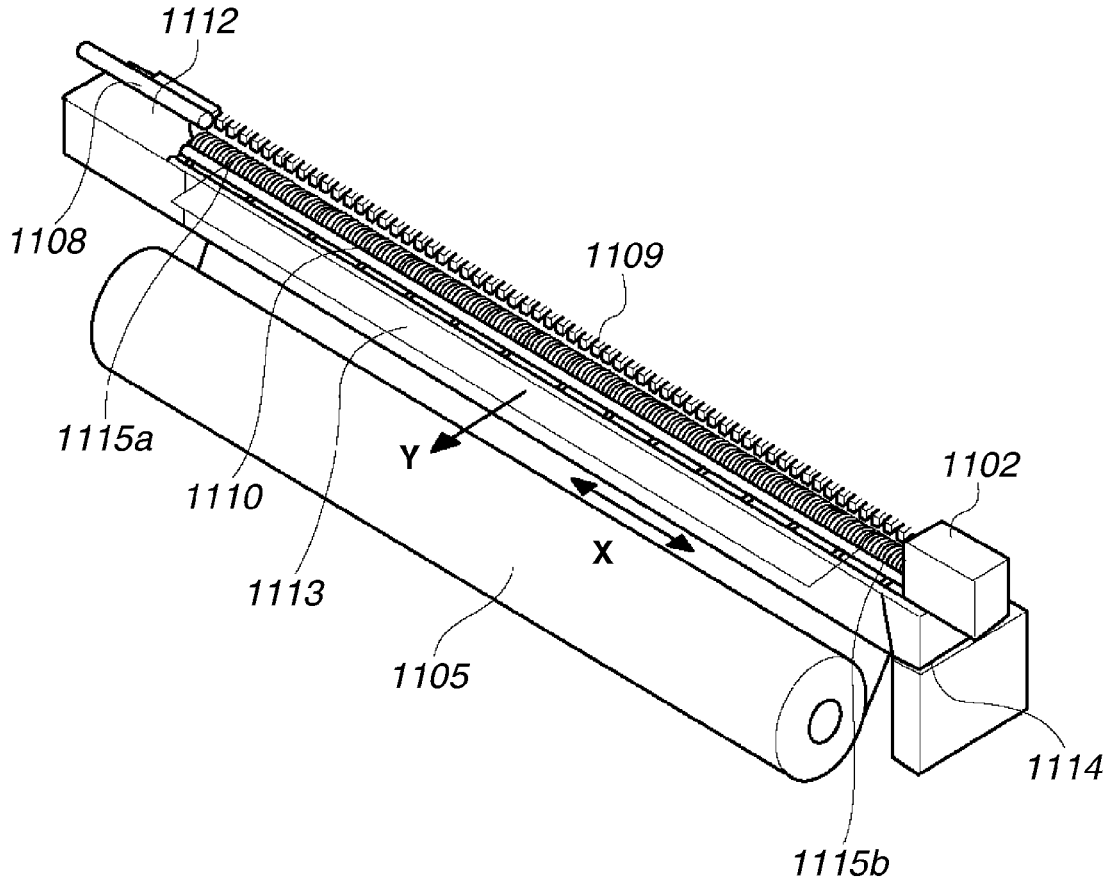
FIG. 12 is a perspective view illustrating vicinity of a casing according to the second exemplary embodiment of the present invention.

FIG. 11 schematically illustrates the entire configuration of an inkjet type printer 1101 according to a second exemplary embodiment of the present invention. FIG. 12 schematically illustrates an internal configuration of the printer 1101 incorporating a device according to the second exemplary embodiment of the present invention. The printer 1101 includes a sheet conveying unit 1103, an image forming unit 1106, a discharging unit 1104, and an operation unit 1107. The sheet conveying unit 1103 holds a roll sheet 1105 rotatably. The sheet conveying unit 1103 conveys a sheet drawn out of the roll sheet 1105. The image forming unit 1106 performs image formation while holding a sheet 1113. The discharging unit 1104 discharges the sheet 1113 to an outside of the printer 1101 after the image formation. A user can set specifications of image formation using the operation unit 1107.

As illustrated in FIG. 12, the image forming unit 1106 is provided with a conveying mechanism which nips (pinches) and conveys the roll sheet 1105 by a predetermined amount when an image is formed. The conveying mechanism includes a line feed (LF) roller 1108 and a plurality of pinch rollers driven to rotate while urging the LF roller 1108 by applying predetermined pressure thereto. In a state in which a sheet is sandwiched between the roller 1108 and each of the pinch rollers 1109, the LF roller 1108 rotates, so that the sheet is conveyed. The sheet conveying mechanism according to the present invention is not limited to such a mechanism configured to convey the sheet by sandwiching the sheet between the two rollers 1108 and 1109. A mechanism can be used, which employs a rotating belt body instead of one or both of the two rollers 1108 and 1109 and which conveys a sheet by pinching the sheet using each belt body.

The image forming unit 1106 includes a platen 1110 for sucking a sheet while holding the sheet in a planar manner, and a carriage 1102 for holding an inkjet type recording head 1111 while causing the recording head 1111 to reciprocatively scan in an X-direction (main scanning direction) perpendicular to the sheet conveying direction Y (auxiliary scanning direction). Various inkjet type recording heads 111 can be used. For example, a recording head of the type using heating elements, a recording head using piezo-elements, a recording head using electrostatic elements, and a recording head using microelectromechanical system (MEMS) elements can be employed.

As illustrated in FIG. 12, a casing 1112 is provided in the printer 1101. The platen 1110, and the sheet conveying unit 1103 for conveying the sheet 1113 to an upstream side in the conveying direction Y above the image forming unit 1106 are formed on the casing 1112. The platen 1110 guides and supports the sheet 1113 such that a predetermined gap is formed between the recording head 1111 and the sheet 1113 placed on the image forming unit 1106.

In the second exemplary embodiment, the platen 1110 includes a suction platen capable of sucking a sheet 1113 to a guide support surface thereof. This suction platen is supported on the top surface of the casing 1112 formed by an enclosed space. The enclosed space of the casing 1112 is connected the platen 1110 by a space. According to the present embodiment, the sheet 1113 is sucked to the guide support surface of the platen 1110 by a suction fan unit 1114 which is disposed at a right end portion of the casing 1112 and has a suction fan. In addition, the carriage 1102 configured to reciprocatively move in the main scanning direction X is supported by a main rail (not shown) extending in a longitudinal direction of the casing 1112. As viewed from a front surface of the body (in the direction of a negative Y-side) illustrated in FIG. 12, a right end and a left end of the sheet 1113 are set to be a reference-side 1115*a* and a non-reference-side 1115*b*, respectively. The carriage 1102, on which the recording head 1111 is placed, is reciprocatively moved between the reference side 1115*a* and the non-reference-side 1115*b*, so that ink is discharged to the sheet 1113 placed on the platen 1110. Thus, printing is performed.

Figure 13:
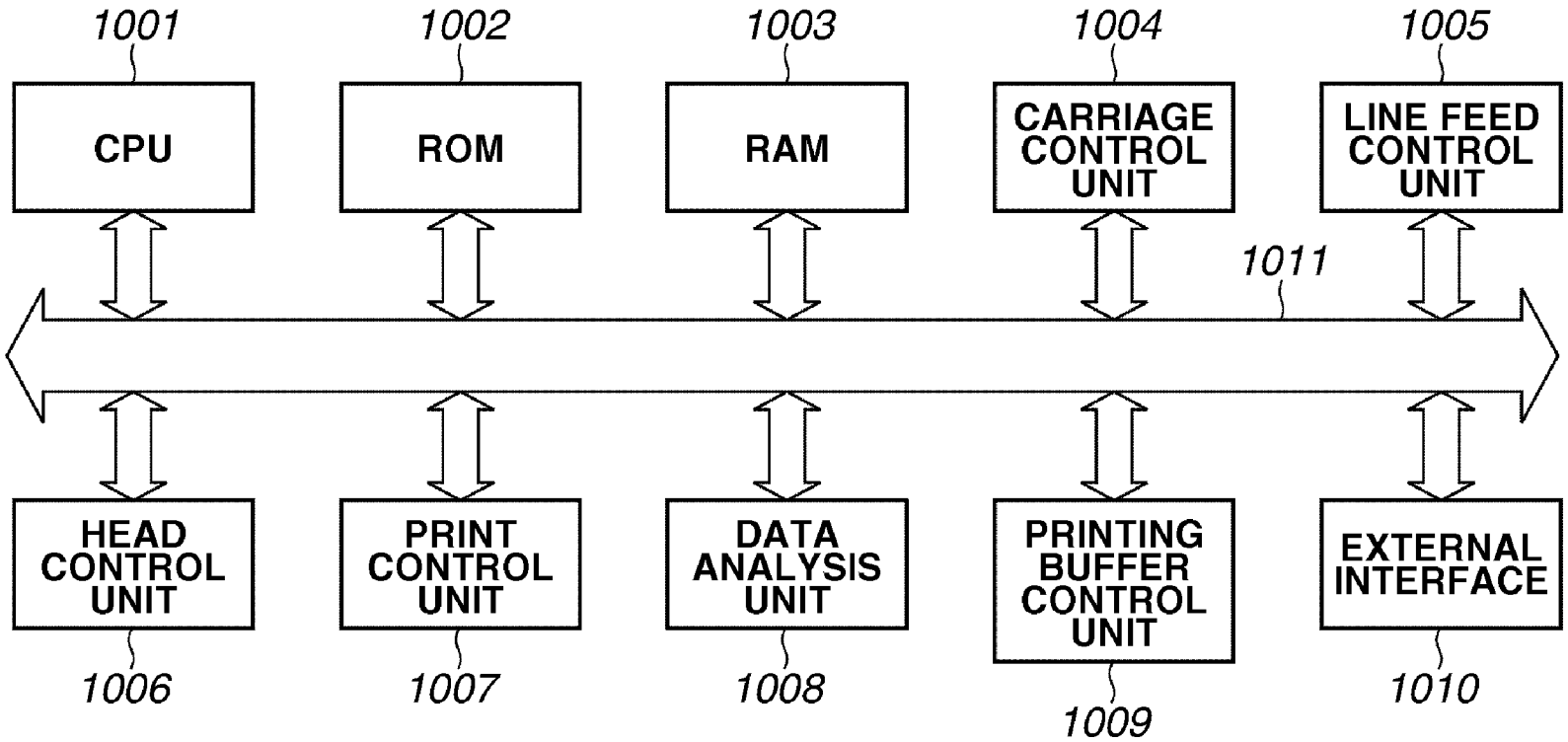
FIG. 13 is a block diagram illustrating a configuration of the printer with a focus on a controller according to the second exemplary embodiment of the present invention.

FIG. 13 is a block diagram illustrating a configuration of the printer with a focus on a control unit (controller) according to the second exemplary embodiment of the present invention. As illustrated in FIG. 13, the control unit includes a CPU 1001, and controls the printer according to a program that is incorporated in a ROM 1002 and illustrated by a program shown in FIG. 18, which will be described below. A RAM 1003 is used as a work area for the CPU 1001, a memory area for storing data received by an external interface 1010, or a memory region for storing print data and data associated with the print data.

A carriage control unit 1004 controls an operation of driving a carriage motor. A line feed control unit 1005 controls driving of a line feed motor. A head control unit 1005 is electrically connected to the recording head and controls driving of the recording head by sensing temperature of the head and controlling appropriately the temperature using a temperature heater or the like. A print control unit 1007 sends control instructions necessary for printing to each of the carriage control unit 1004, the line feed control unit 1005, and the head control unit 1006, based on data sent thereto from various control units.

A data analysis unit 1008 analyzes data received by the external interface 1010 and sends an analysis result to the print control unit 7 or to the print buffer control unit 1009. The print buffer control unit 1009 controls, based on data analyzed by the data analysis unit 1008, the sizes and the number of memory areas which store print data saved in the RAM 103. The external interface 1010 receives data sent from an external host computer and the like. A system bus 1011 connects the above units to one another.

Next, a mechanical configuration and an operation of the second exemplary embodiment are described hereinafter with reference to FIGS. 14 to 18. This printer can turn off power in a state (nip state) in which a leading edge of a roll sheet is nipped. In a non-operational state of the device, the nip state can be released by a user's operation performed on the release lever 1022. More specifically, the release lever 1022 is used to put a sheet into a nip state, and to release the nip state. For example, when the release lever 1022 is set at a position illustrated in FIG. 14, a sheet is pinched by two rollers. Thus, the sheet is put into a nip state. On the other hand, when the lever is set at a position illustrated in FIG. 15, a minute space between the two rollers is generated to thereby release the nip state.

Figure 14:
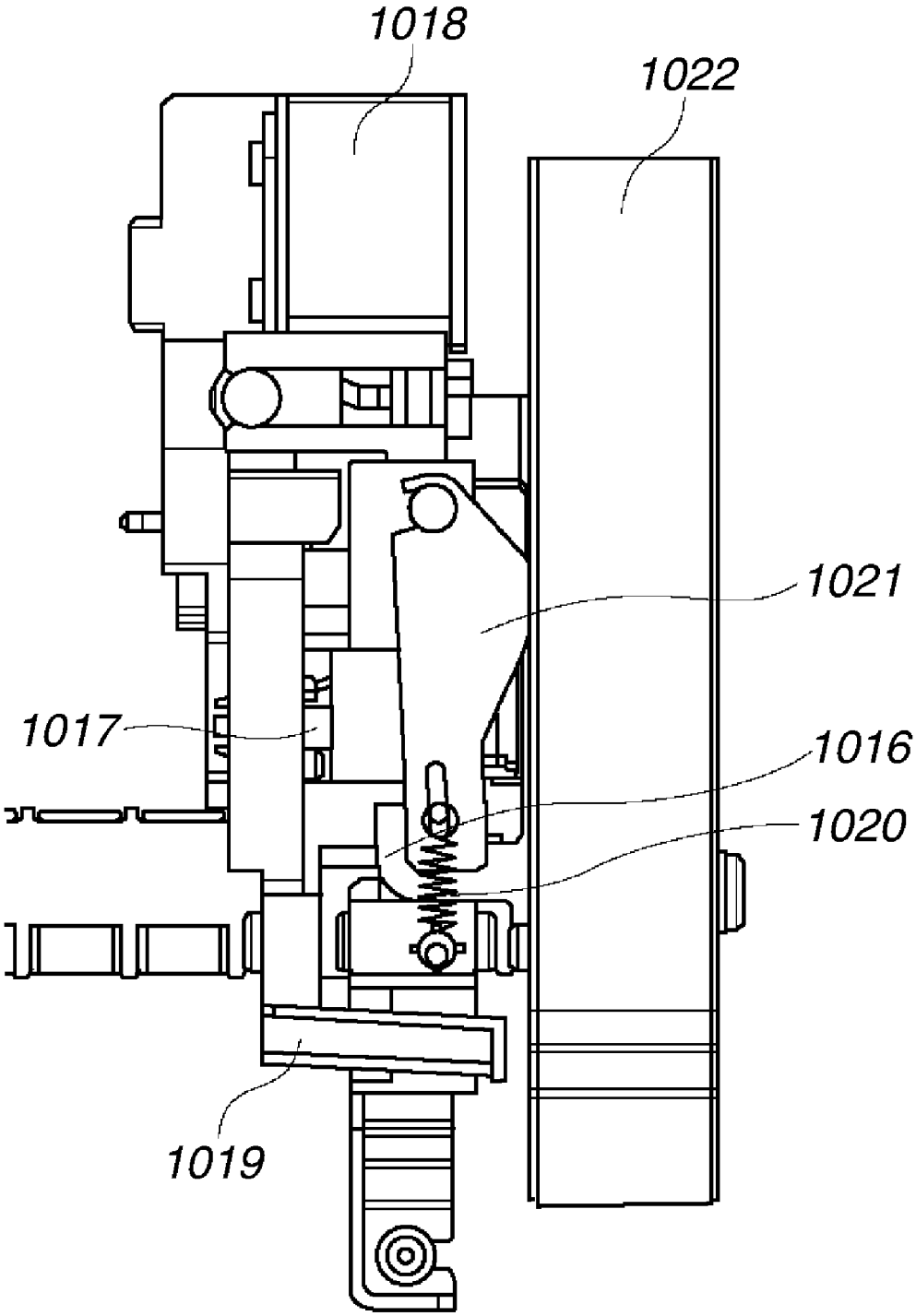
FIG. 14 illustrates a state in which a flag lever according to the second exemplary embodiment is in an open state.

A flag lever (second lever) 1016 illustrated in FIG. 14 is configured to change a position thereof interlocking with an operation of releasing a nip state, which is performed by the release lever (first lever) 1022. The flag lever 1016 constitutes apart of a mechanical storage mechanism which will be described below. When a sheet is put into a nip state, the flag lever 1016 is placed at a position (first position) illustrated in FIG. 14. Hereinafter, a state in which the flag lever 1016 is placed at such a position is referred to as an "open state" or a "state in which a flag is not set". When the nip state of a sheet is released, the flag lever 1016 is placed at a position (second position) illustrated in FIG. 15 interlocking with movement of each of a torsion spring 1020 and a lever 1021. Hereinafter, a state in which the flag lever 1016 is placed at such a position is referred to as a "closed state" or a "state in which a flag is set". Operating of the release lever 22 to change the position illustrated in FIG. 14 to that illustrated in FIG. 15 is referred to as a "first changeover".

A sensor 1017 detects a change in position (flag state) of the flag lever 1016. The sensor 1017 is a detection unit for detecting a state (contents) of storage of a storage mechanism including the flag lever 1016. The detection unit is a reading unit for reading the contents of storage of the storage mechanism. The sensor 1017 includes, for example, a photo-interrupter having a light source and a photo-receiver. When the flag lever 1016 is in an open state illustrated in FIG. 14, the presence of the flag lever 1016 can be detected according to two states, i.e., a transmission state in which light is transmitted between the light source and the photo-receiver, and an interruption state in which light is interrupted therebetween. When the flag lever 1016 is in an open state illustrated in FIG. 14, light is transmitted therebetween. Thus, the sensor 1017 detects that the flag lever 16 is in an open state.

Figure 15:
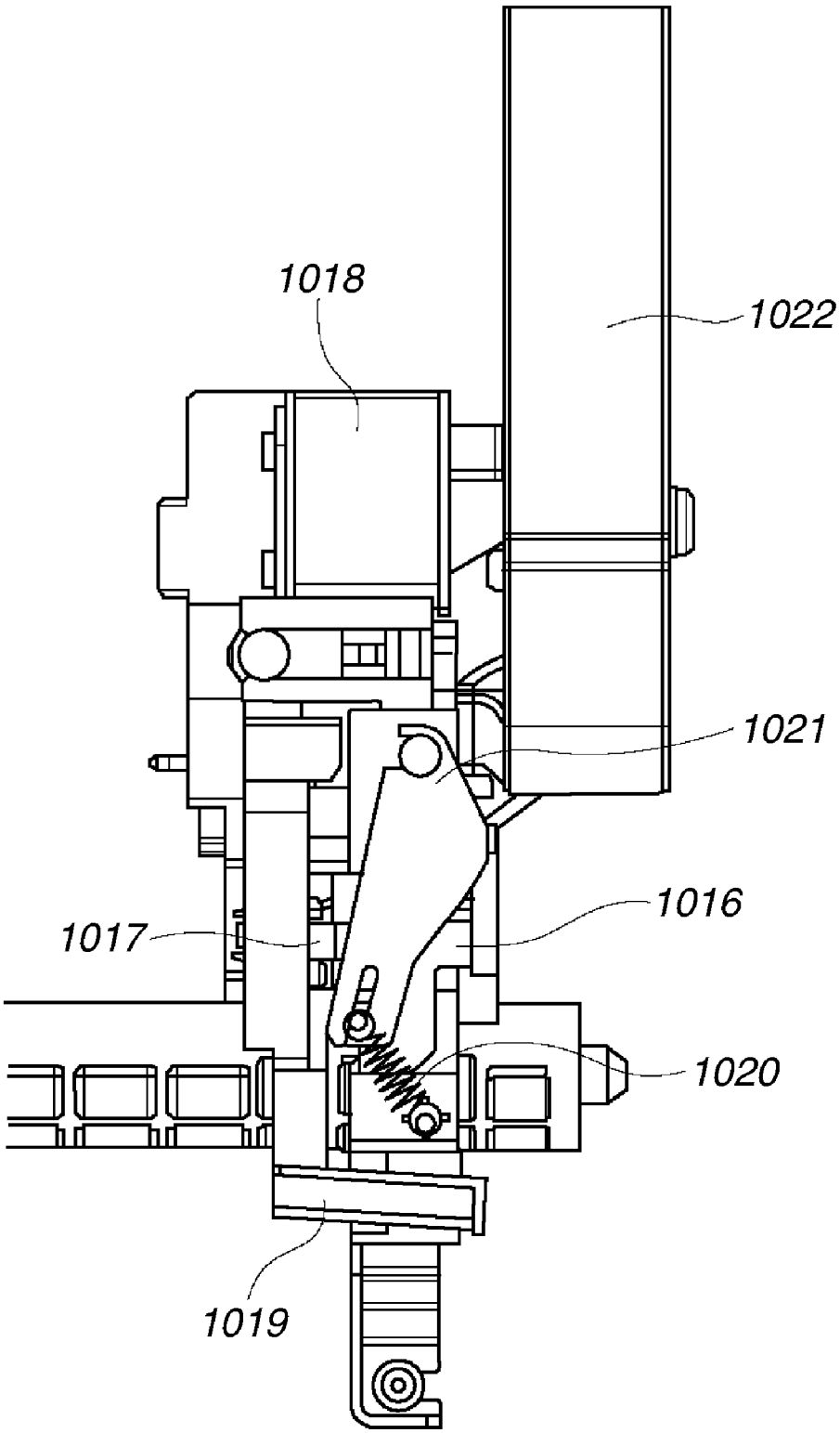
FIG. 15 illustrates a state in which the flag lever according to the second exemplary embodiment is in a closed state.

On the other hand, when the flag lever 1016 is in a closed state illustrated in FIG. 15, light is interrupted therebetween. Thus, the sensor 1017 detects that the flag lever 1016 is in a closed state. The release lever 1022, the flag lever 1016, and the sensor 1017 are mounted on an extension of the shaft of the LF roller 1108 illustrated in FIG. 12. As viewed from the front side (negative Y-side) of the body, the release lever 1022, the flag lever 1016, and the sensor 1017 are attached to the reference side 1115*a* of the right end of the sheet 1113. The sensor 1017 according to the present invention is not limited to an optical sensor. Other sensors can be used, which detect the state of the flag lever using other techniques, such as a mechanical sensor and a magnetic sensor.

FIG. 14 illustrates the opened state of the flag lever, e.g., a state when a sheet is set in the printer and an initialization operation of the printer is completed. When the flag lever is in an open state, the release lever 1022 is in a state in which the sheet is nipped. FIG. 15 illustrates a state in which the nip state of the sheet is released, and in which the flag lever is in a closed state. The flag lever 1016 changes a position thereof from that illustrated in FIG. 14 to that illustrated in FIG. 15 interlocking with a release operation of the release lever 1022. That is, the release lever 1022 is operated, so that the state of the flag lever 1016 is changed from the open state to the closed state.

Figure 16:
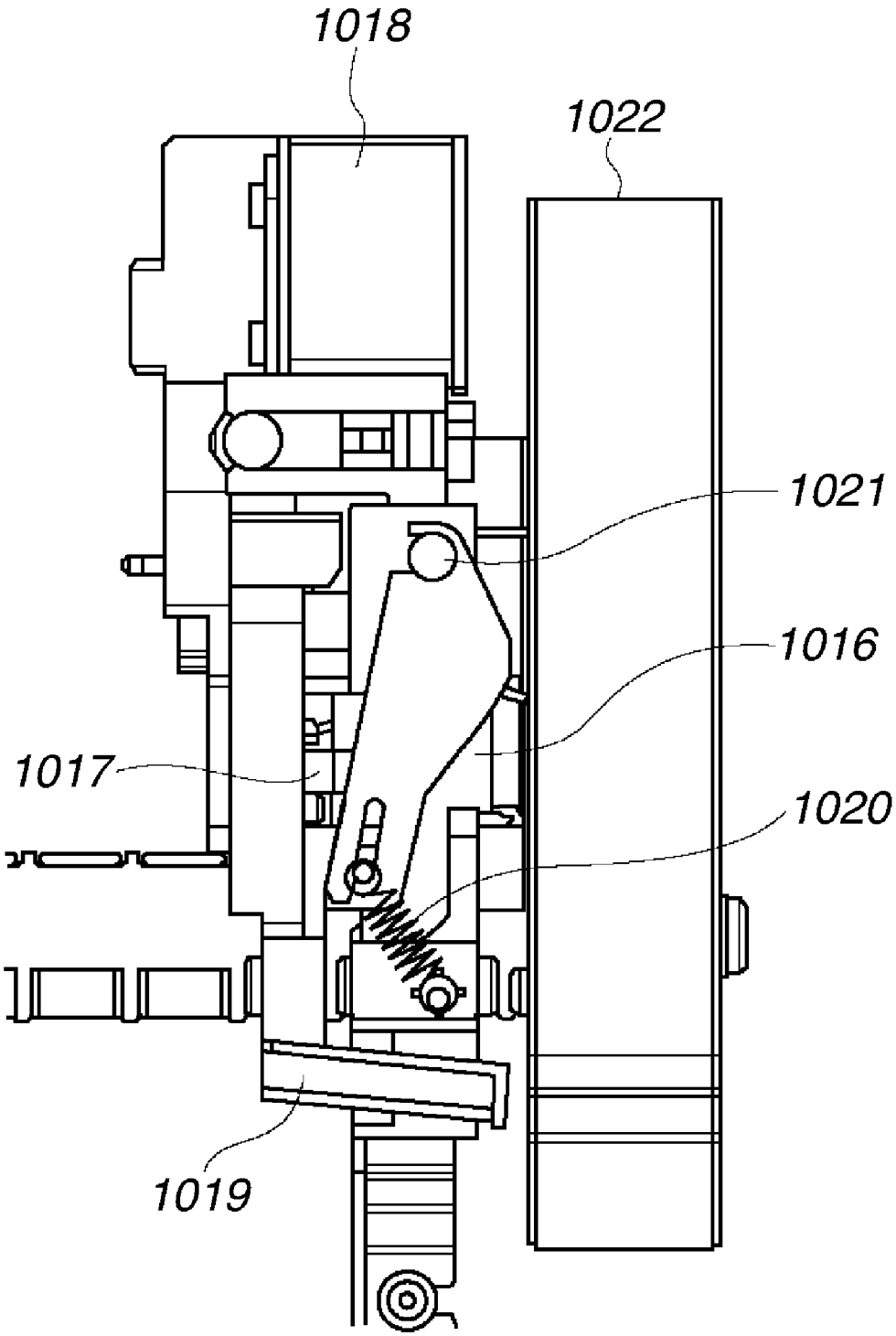
FIG. 16 illustrates a state in which, after a nip state of a sheet according to the second exemplary embodiment is once released, the sheet is put into the nip state again.

FIG. 16 illustrates a state in which a sheet is put into a nip state again after the nip state of the sheet is released. Even when the state of the release lever 1022 is changed from that illustrated in FIG. 15 to that illustrated in FIG. 16, the flag lever 1016 maintains a positional state thereof without being interlocked with the operation of the release lever 1022 after the position of the flag lever 1016 is once changed from that illustrated in FIG. 14 to that illustrated in FIG. 15. Thus, the flag lever 1016 is brought into a state in which the flag is kept set. As is seen from FIGS. 15 and 16, the position of the flag lever 1016 does not change. More specifically, the storage mechanism including the flag lever 1016 mechanically memorizes a fact (event) that in a non-operational state, the nip state is released by operating the release lever 1022. The memory mechanism maintains a memory of such an event.

The memory mechanism has the flag lever 1016 which is displaced interlocking with the movement of the release lever 1022. When the release lever 1022 is operated to release the nip, the flag lever 1016 is displaced so that the flag is set. Thus, the memory mechanism memorizes such an event. After the flag lever 1016 is once displaced so that the flag is set, the flag lever is not displaced interlocking with the movement of the release lever 1022 even when the release lever 1022 is subsequently operated so that a sheet is nipped. The memory mechanism maintains a memory of a state in which the flag is set. The detection unit including the sensor 1017 detects a flag state of the flag lever 1016. Thus, when the release lever 1022 is once operated while the printer is powered off (in a non-operational state of the device), this operation of the release lever 1022 can be recognized from the event (flag state) mechanically memorized by the flag lever 1016. Operating of the release lever 22 to change the position illustrated in FIG. 15 to that illustrated in FIG. 16 is referred to as a "second changeover".

Figure 17:
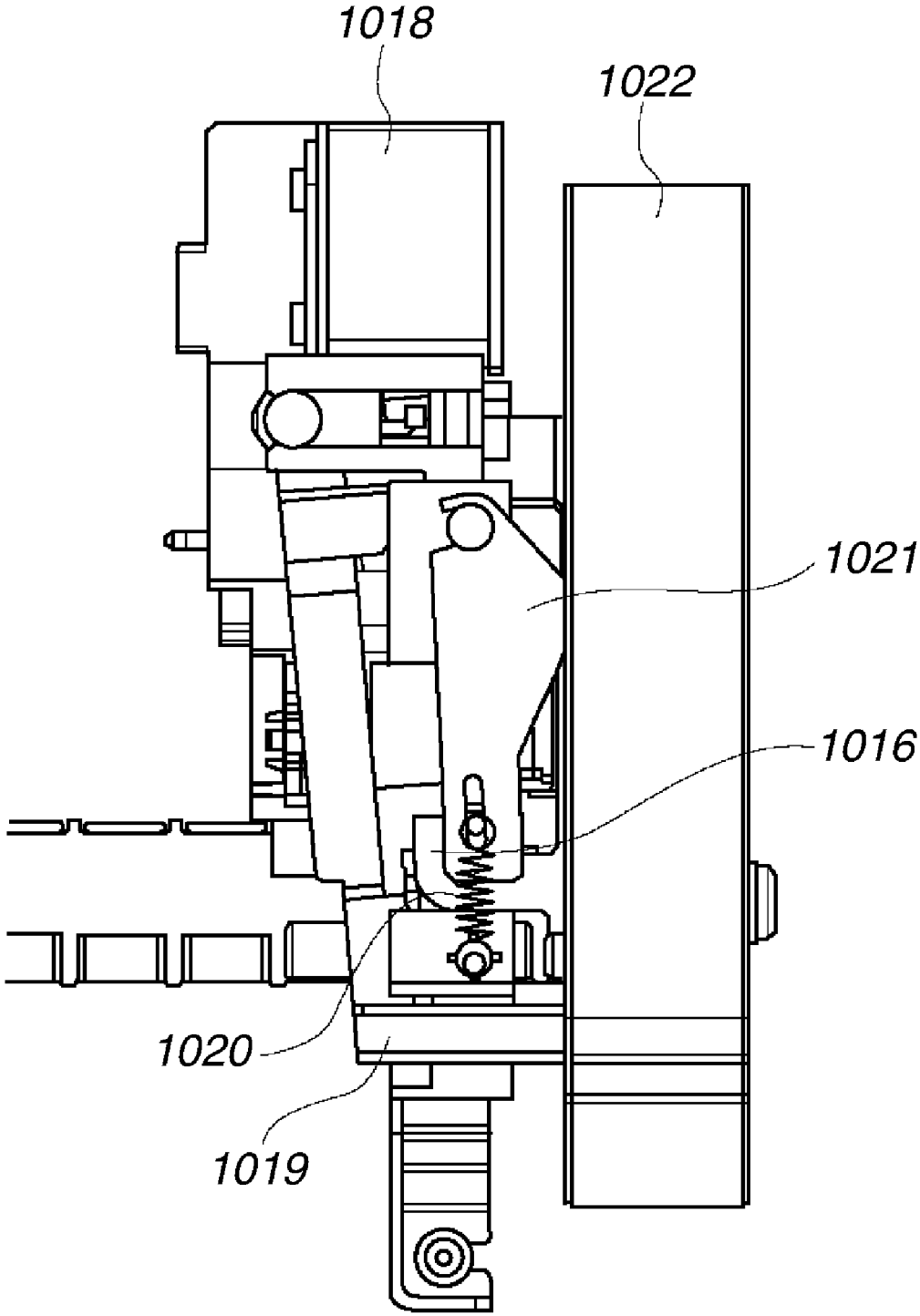
FIG. 17 illustrates a state in which, after the printer according to the second exemplary embodiment is powered on, the flag lever is put back into the open state again.

FIG. 17 illustrates a state in which, after the printer is powered on, the flag lever 1016 is returned to an open state again. An interlocking mechanism is operated under control of the control unit when a roll sheet lateral-deviation correction sequence to be performed after power-on is started. The interlocking mechanism is provided with the solenoid 1018. The solenoid 1018 is turned on under control of the control unit. Thus, the position of a lock lever 1019 is changed to that at the right side thereof, as viewed in FIG. 17. Then, the flag lever 1016 is pushed to put back the flag lever 1016 into the open state. In the release lever 1022, a groove portion, into which an engagement portion of the lock lever 1019 is fit, is formed. When the solenoid 1018 is turned on, a user is inhibited from operating this lever. The flag lever 1016 in a closed state (a state in which the flag is set) is returned to the position in response to an operation of the interlocking mechanism. More specifically, contents of an event memorized mechanically by the memory mechanism are reset (i.e., the memory of the event is reset) interlocking with an operation of the interlocking mechanism. Supplementarily speaking, after the detection unit detects the flag state of the flag lever 1016, the control unit operates the interlocking mechanism.

Figure 18:
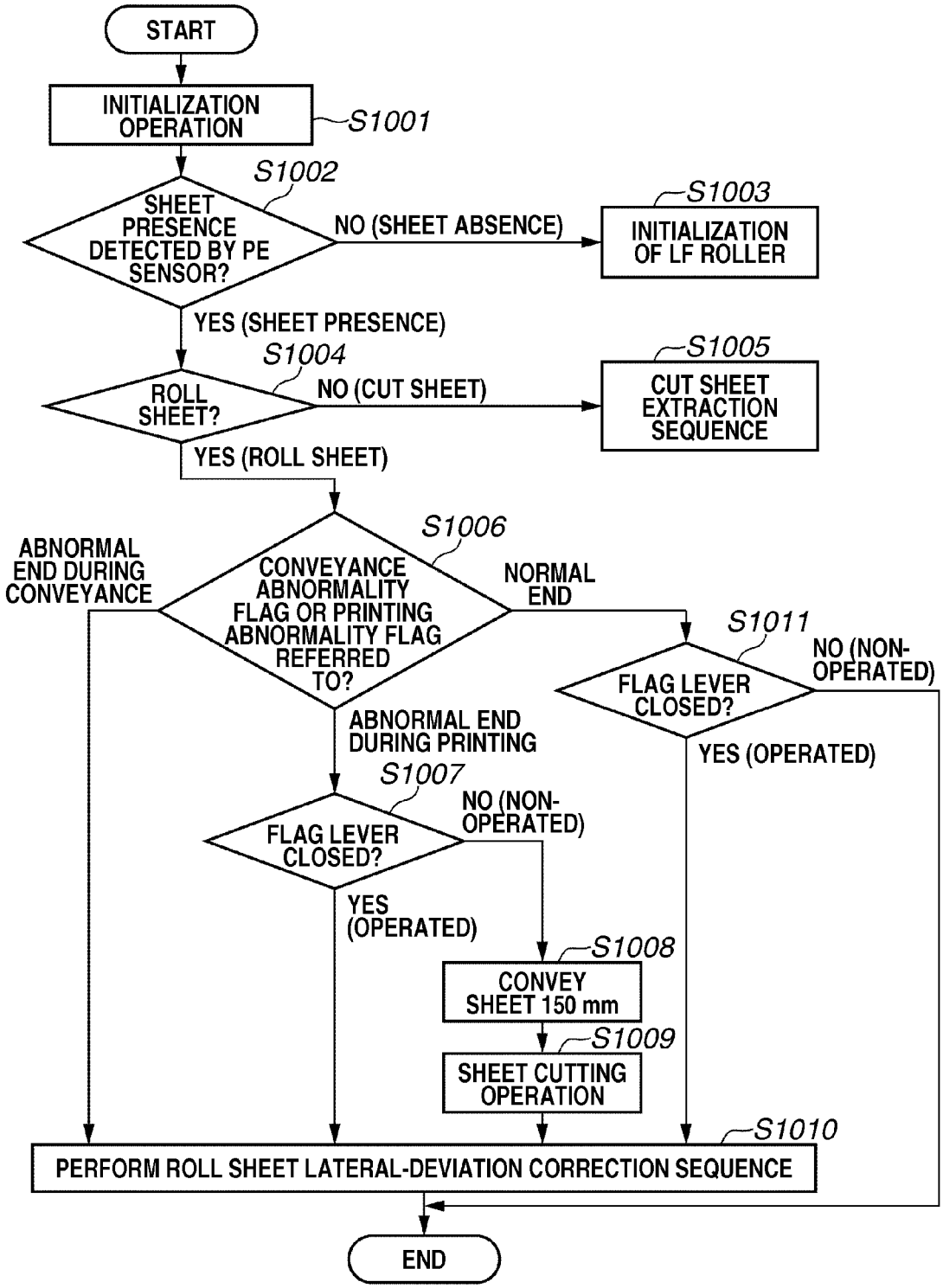
FIG. 18 is a flowchart illustrating a procedure for performing a lateral-deviation correction sequence.

FIG. 18 is a flowchart illustrating a control procedure to be performed by the control unit to determine whether a roll sheet lateral-deviation correction sequence is to be performed. First, in step S1001, when a sheet is set in the printer, an initialization operation is performed. In step S1002, the presence or absence of a sheet is determined by a pyroelectric (PE) sensor provided in the sheet conveying unit 1103. If it is determined that there is no sheet (NO in step S1002), the procedure proceeds to step S1003, in which an initialization operation of the LF roller is performed. On the other hand, if it is determined that there is a sheet (YES in step S1002), the procedure proceeds to step S1004 in which it is determined whether the sheet is a roll sheet or a cut-sheet. If it is determined that the sheet is a cut-sheet (NO in step S1004), the procedure proceeds to step S1005, in which a cut-sheet discharging sequence is performed. On the other hand, if it is determined that the sheet is a roll sheet (YES in step S1004), the procedure proceeds to step S1006.

As described above, whether the lateral-deviation correction sequence is to be performed is controlled according to whether the flag lever 1016 is in an open state (a state in which the flag is not set) or in a closed state (a state in which the flag is set). Hereinafter, a mode in which the device is controlled so that a lateral-deviation correction sequence is performed is referred to as a non-usual control mode. Another mode in which the device is controlled so that a lateral-deviation correction sequence is not performed is referred to as a usual control mode. In the present embodiment, the memory-device of the control unit stores a control start flag indicating that a non-usual control mode is started. Similarly, in preceding print-processing, the memory of the control unit stores an "abnormality-in-conveyance flag" indicating that abnormality occurs in conveyance of a sheet, and that the conveyance of the sheet is aborted. In addition, the memory-device of the control unit stores an "abnormality-in-print flag" indicating that abnormality occurs in printing, and that the print-processing is aborted.

In step S1006, the abnormality-in-conveyance flag and the abnormality-in-print are referred to. Thus, it is determined whether the preceding processing is aborted or normally ended. If at least one of the value of the abnormality-in-conveyance flag and that of the abnormality-in-print flag is "true", a control start flag is set to be "true". If the abnormality-in-conveyance flag is "true", it is determined that abnormality occurs while a sheet is conveyed, and that the conveyance is aborted. Then, the procedure proceeds to step S1010, in which a roll sheet lateral-deviation correction sequence (correction processing) is performed. If the value of the abnormality-in-print flag is true, it is determined that abnormality occurs while printing is performed on a sheet, and that the printing is aborted. Then, the procedure proceeds to step S1007.

In step S1007, it is determined whether the flag lever 1016 is in a closed state. For this determination, the state of the flag lever 1016 is detected by the sensor 1017, as described above. If it is determined that the flag lever 1016 is in a closed state (a state in which the flag is set) (YES in step S1007), the lever has been operated. Thus, the procedure proceeds to step S1010, in which a lateral-deviation correction sequence is performed. Because practical techniques for the lateral-deviation correction sequence are known, the detailed description of the practical techniques for the lateral-deviation correction sequence is omitted. On the other hand, if it is determined that the flag lever 1016 is in an open state (a state in which the flag is not set) (NO in step S1007), the lever has not been operated. Thus, the procedure proceeds to step S1008.

Processing in steps S1008 and S1009 is performed when a sheet is cut. For example, in step S1008, the sheet is conveyed, e.g., 150 mm. In step S1009, an operation of cutting a sheet is performed. After the processing is performed in step S1109, the procedure proceeds to step S1010, in which the roll sheet lateral-deviation detection sequence is performed. If sheet cutting performed in steps 1008 and 1009 is unnecessary, steps S1008 and S1009 can be omitted.

As described in steps S1006 to S1010, if it is determined that the preceding processing is aborted as indicated by the abnormality-in-conveyance flag and the abnormality-in-print flag, the lateral-deviation correction sequence is performed regardless of the flag state of the flag lever 16. In other words, the lateral-deviation correction sequence is performed regardless of the contents of the event memorized by the memory mechanism.

In step S1006, the flags are referred to again. If it is determined that abortion is not indicated by the control start flag in step S1006, and that processing is normally ended, the procedure proceeds to step S1011. In step S1011, it is determined whether the flag lever 1016 is in a closed state, similarly to the determination in step S1007. If it is determined that the flag lever 1016 is in a closed state (YES in step S1011), the lever has been operated. Thus, the procedure proceeds to step S1010, in which the roll sheet lateral-deviation correction sequence is performed. On the other hand, if it is determined that the flag lever 1016 is in an open state, the lever has not been operated. Thus, this procedure is finished without performing the lateral-deviation correction sequence. In other words, the execution of the lateral-deviation correction sequence is omitted. When the lateral-deviation correction sequence in step S1010 is finished, the control start flag is set to be false. As described above with reference to FIG. 17, the flag lever 1016 put in a closed state is returned to a position corresponding to an open state, interlocking with the interlocking mechanism before the roll sheet lateral-deviation correction sequence is started. Then, the memory memorized in the memory mechanism is reset.

According to the above second exemplary embodiment, the memory mechanism mechanically memorizes an event that the nip state of a sheet is released by the lever in a non-operational state of the device (during power-off). Then, at power-on, the memory of the event is detected. Thus, it can be controlled whether the roll sheet lateral-deviation correction sequence is to be performed. If it is determined that the nip state of a sheet is not released by the lever during power-off, the roll sheet lateral-deviation correction sequence is omitted.

If it is detected by referring to the abnormality-in-conveyance flag and the abnormality-in-print flag that the processing is aborted, the roll sheet lateral-deviation correction sequence is performed, regardless of whether the nip state is released during power-off. More specifically, if abnormality capable of causing the lateral deviation of a roll sheet is caused when the printer is powered on, the roll sheet lateral-deviation correction sequence necessarily is performed. Thus, the skew feed and the lateral deviation of a sheet can be prevented. If the processing is normally completed without abnormality, unnecessary roll sheet lateral-deviation correction sequence can be omitted to thereby prevent reduction in throughput.

In the foregoing description, the first exemplary embodiment and the second exemplary embodiment have been described. However, the present invention can be applied to a combination of a part of components of the first exemplary embodiment and the second exemplary embodiment, and to a combination of the first exemplary embodiment and a part of components of the second exemplary embodiment.

The first exemplary embodiment can be modified by providing it with a mechanical flag which interlocks with a separation operation of the rollers 9 and 10 of the roller pair, and adapting to detect a state of the flag with a photosensor. Alternatively, the embodiment can be modified so that when the rollers 9 and 10 of the roller pair are separated from each other, this separation of the rollers 9 and 10 is displayed in the display unit of the printer.

Although the above embodiments of the present invention have been applied to the printers, the present invention can also be applied to an image reading apparatus provided with a scanner unit as long as a sheet can be held by and released from the rollers.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2008-262996 filed Oct. 9, 2008 and No. 2009-044323 filed Feb. 26, 2009, which are hereby incorporated by reference herein in their entirety.

What is claimed is:

1. A conveying device comprising:

a pair of rollers configured to convey a sheet;

a separating unit configured to separate one of the pair of rollers from another of the pair of rollers;

a holding unit configured to retain a status representing whether the separating unit was manually operated by a user in power-off state;

a memory unit configured to store information representing a state of the separating unit before entering the power-off state; and a control unit configured to control a conveyance of the sheet with the pair of rollers after power-on, based on the status retained by the holding unit and the information stored by the memory unit.

2. The conveying device according to claim 1, wherein, in a case where the holding unit retains a status indicating that the separation unit was operated to separate the pair of rollers, and where the memory unit stores information representing a standby state, the control unit controls the device to perform a lateral-deviation correction operation before conveying the sheet.

3. The conveying device according to claim 1, further comprising:

a lever configured that the user can operate the separating unit regardless of whether the device is powered on or off; and a detection unit configured to detect a state of a mechanical flag as the holding unit which moves with the lever.

4. The conveying device according to claim 3, wherein the control unit brings, after the detection by the detection unit, the mechanical flag into an initial state.

5. A recording apparatus for recording images on the sheet including a conveying device according to claim 1.

6. A conveying device comprising:

a conveying mechanism configured to nip and convey a sheet;

a release lever configured to release, by a manual operation by a user, the conveying mechanism from a state in which a sheet is nipped to a nip release state;

a memory mechanism configured to mechanically memorize an event in power-off state that the nip release state is caused by the release lever; and a detection unit configured to detect, after power-on, that the memory mechanism memorizes the event event; and a control unit configured to control the device so as to change operations, after power-on, in response to a result of detection by the detection unit, wherein, when the detection unit detects that the release lever is operated to cause the nip release state, the control unit performs a correction process of correcting a conveyance of the sheet with the conveying mechanism.

7. The conveying device according to claim 6, wherein, when the detection unit detects that the release lever is not operated, the control unit omits execution of the correction process.

8. A recording apparatus for recording images on the sheet including a conveying device according to claim 6.

9. A conveying device comprising:

a conveying mechanism configured to nip and convey a sheet;

a release lever configured to release, by a manual operation by a user, the conveying mechanism from a state in which a sheet is nipped to a nip release state:

a mechanical flag displaceable with the release lever configured to mechanically memorize an event in power-off state that the nip release state is caused by the release lever; and a detection unit configured to detect a state of the mechanical flag after power-on, wherein, when the release lever is operated to cause the nip release state, the mechanical flag is set, and wherein once the mechanical flag is set, the mechanical flag is maintained even when the release lever is subsequently operated to cause the state in which the sheet is nipped in the power-off state.

10. The conveying device according to claim 9, wherein the detection unit comprises a sensor configured to optically detect a state of the mechanical flag.

11. The conveying device according to claim 9, further comprising a control unit configured to control the device so as to change operations, after power-on, in response to the state of the mechanical flag detected by the detection unit.

12. A conveying device comprising:

a conveying mechanism configured to nip and convey a sheet;

a release lever configured to release, by a manual operation by a user, the conveying mechanism from a state in which a sheet is nipped to a nip release state:

a mechanical flag displaceable with the release lever configured to mechanically memorize an event in power-off state that the nip release state is caused by the release lever;

a detection unit configured to detect a state of the mechanical flag after power-on; and an interlocking mechanism configured to inhibit an operation of the release lever by the user after the power-on, wherein the mechanical flag is reset with an operation of the interlocking mechanism.

13. The conveying device according to claim 12, further comprising a control unit configured to control the device so as to change operations, after power-on, in response to the state of the mechanical flag detected by the detection unit.

* * * * *